US006044575A

United States Patent [19]

Marschke

[11] Patent Number: 6,044,575

[45] Date of Patent: Apr. 4, 2000

[54] CONDENSATE REMOVAL FROM HIGH SPEED ROLL

[75] Inventor: Carl R. Marschke, Phillips, Wis.

[73] Assignee: Marquip, Inc., Phillips, Wis.

[21] Appl. No.: 09/174,738

[22] Filed: Oct. 19, 1998

[51] Int. Cl.[7] ..... F26B 11/02

[52] U.S. Cl. ..... 34/124; 34/125

[58] Field of Search ..... 34/115, 119, 120, 34/124, 125; 165/89, 90; 492/20, 9, 46; 162/207, 208, 358.3

[56] References Cited

U.S. PATENT DOCUMENTS

| | | | |
|---|---|---|---|
| 2,893,136 | 7/1959 | Justus et al. | 34/119 |
| 3,303,576 | 2/1967 | Sisson | 34/122 |
| 4,501,075 | 2/1985 | Jenker et al. | 34/125 |
| 4,556,450 | 12/1985 | Chuang et al. | 162/204 |
| 5,878,507 | 3/1999 | Schiel et al. | 34/119 |
| 5,899,264 | 5/1999 | Marschke | 165/89 |

*Primary Examiner*—Stephen Gravini
*Attorney, Agent, or Firm*—Andrus, Sceales, Starke & Sawall

[57] ABSTRACT

A rotary steam heated roll of the type having a series of circumferentially spaced, generally parallel and axially extending condensate channels or open-ended steam tubes in the cylindrical outer wall, includes at least one condensate removal pump associated with a channel or steam tube to positively pump condensate which rims at high speed radially inward to the center of the roll for discharge. A preferred embodiment includes a plurality of small piston pumps driven in response to roll rotation and timed to provide sequential circumferential operation.

27 Claims, 4 Drawing Sheets

FIG. 1
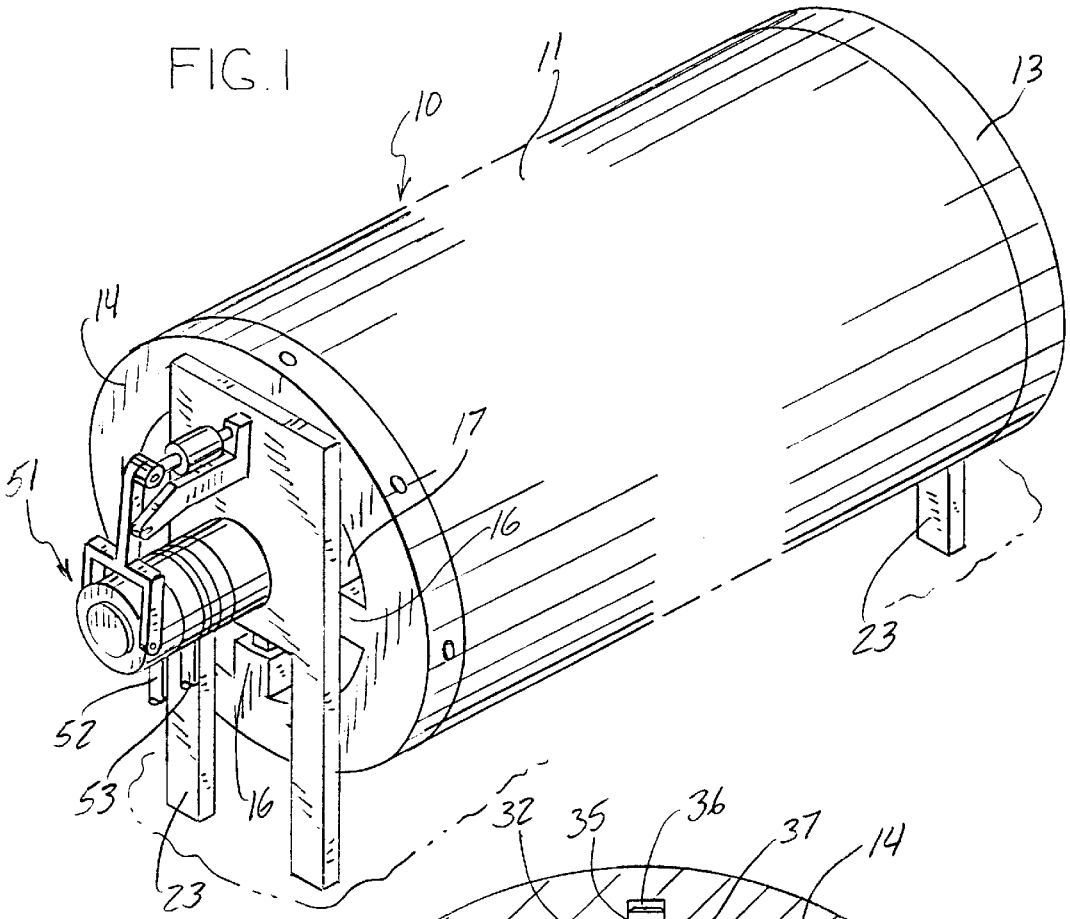
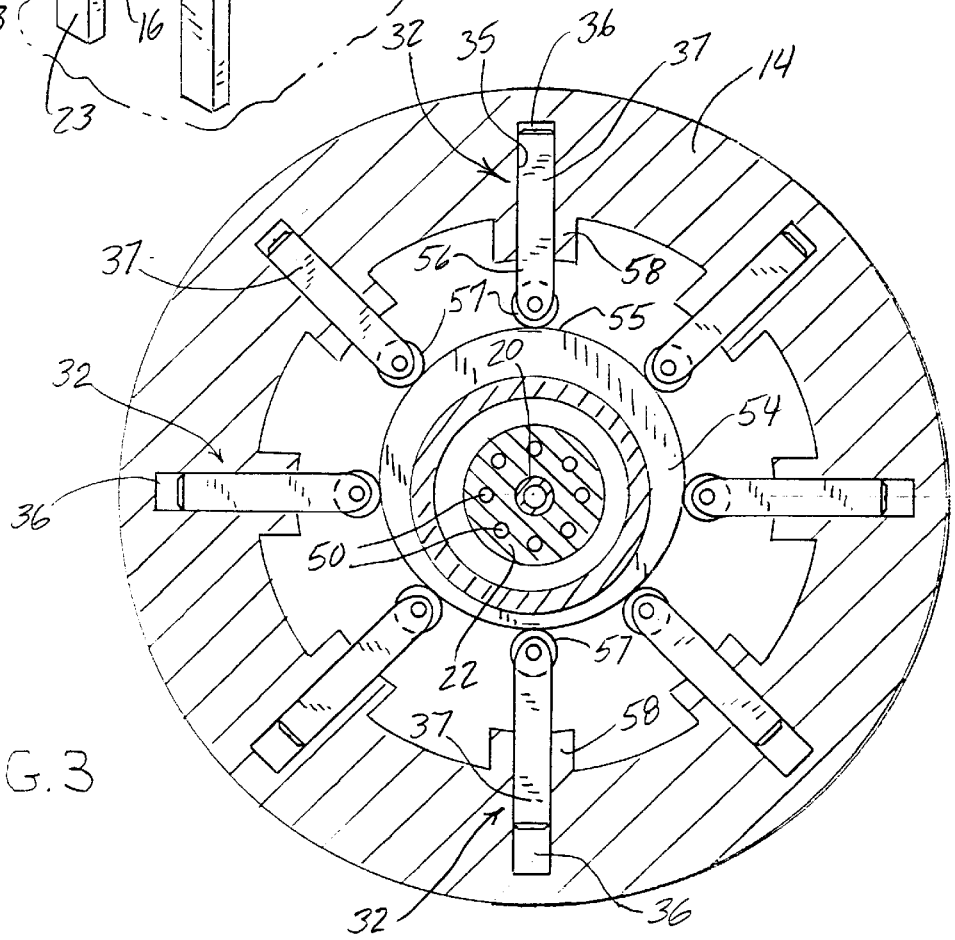
FIG. 3

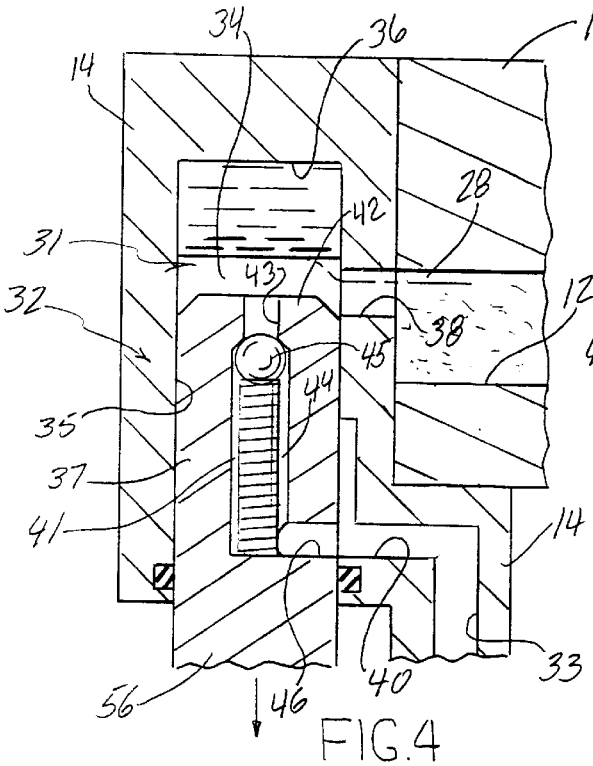
FIG.4
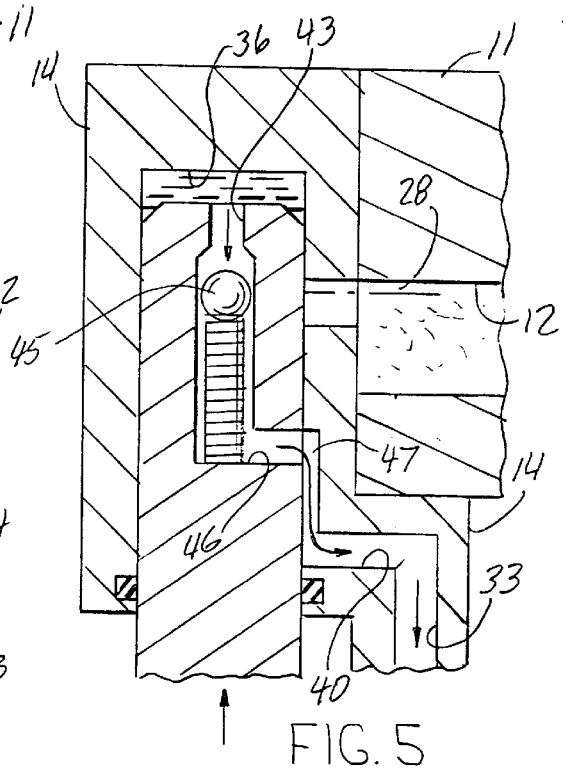
FIG.5
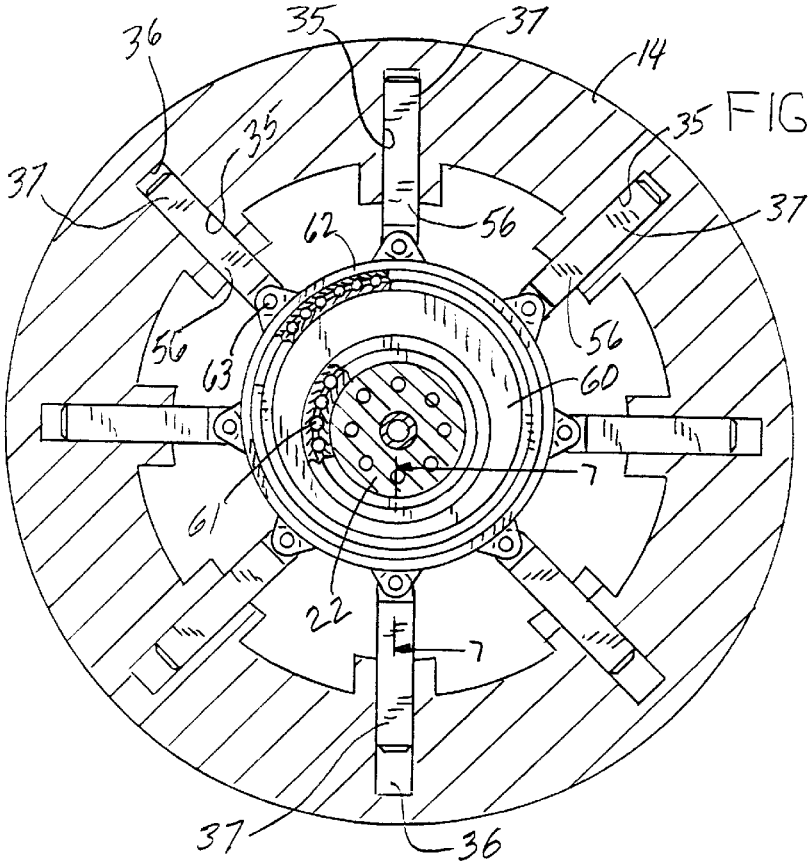
FIG.6
FIG.7
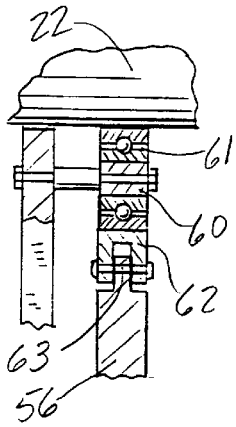

CONDENSATE REMOVAL FROM HIGH SPEED ROLL

BACKGROUND OF THE INVENTION

The present invention pertains to an apparatus for removing condensate from a high speed, steam heated rotary cylindrical roll and, more particularly, to an apparatus which provides positive pumped removal of condensate.

Rotary cylindrical rolls are used in a wide variety of material treating applications. In one particularly well known use, webs of material to be treated are wrapped around a heated rotary roll which transmits heat to the web. Steam is the most commonly used heating fluid and steam heated rolls are well known in the art. Typically, steam is supplied to and condensate water removed from the interior of the roll via axial bores in the roll shaft and utilizing joints for steam supply and siphon tubes for condensate withdrawal. The steam may be supplied to the entire open interior of the roll or may be directed to axial passages formed in the interior cylindrical wall of the roll. Condensate removal may be effected with a non-rotating siphon tube having an inlet positioned near the interior of the roll shell at the lowermost point of roll rotation. Alternately, the roll may be provided with radially extending condensate removal tubes which extend from the roll shell inwardly to a common condensate outlet in the roll shaft.

In co-pending and commonly assigned U.S. patent application Ser. No. 08/932,332, filed Sep. 17, 1997, an apparatus is disclosed for removing condensate from a steam heated roll operating either at rimming speed, when the condensate is evenly distributed by centrifugal force around the inside of the roll shell, or at low speed when gravity causes the condensate to pool at the bottom of the roll shell. The disclosure of that application is incorporated herein by, reference. In the apparatus disclosed therein, steam is supplied to a series of circumferentially spaced, generally parallel and axially extending open ended steam tubes in the cylindrical outer wall of the roll. Steam is supplied to the tubes and steam pressure differential moves the condensate out of the opposite tube ends and radially inwardly to the axis of the roll where the condensate is discharged through a connection to the roll shaft. With heated roll diameters up to about 48 inches (1,220 mm), and handling webs having a line speed up to about 1,300 feet per minute, the corresponding rotational speed is 100 rpm. The centrifugal force causing rimming at this speed may be overcome by system steam pressure differential sufficient to allow the condensate to be removed.

However, in certain industries, much larger heated rolls operating at much greater speeds are utilized. For example, in the paper industry, a web drying roll may be made to a diameter of 72 inches (about 1,830 mm), rotated to handle a web speed of 6,000 feet per minute, requiring a roll speed of about 320 rpm. At this high rotational speed, the centrifugal force on the condensate is so great that condensate cannot be efficiently removed under the influence of system steam pressure alone. The prior art discloses complex arrangements for removing condensate from high speed rolls using elaborate nozzle arrangements positioned in close proximity to the thin layers of condensate created by rimming. At high roll speeds, external suction pumps are required to assist in the removal of condensate, but rotational speeds may be so high that even these pumps are ineffective. Therefore, the detrimental insulating effects of condensate and the difficulty of effectively removing condensate remain a problem.

SUMMARY OF THE INVENTION

The condensate removal system of the present invention may be applied to heated rolls in which the steam is supplied to the entire open interior of the roll or to rolls in which steam is directed to closed axial passages formed in the cylindrical wall of the roll. In either application of the, invention, steam condensate is collected along inner surface portions of the cylindrical wall of the roll during roll rotation and is directed to a radially outermost one of said surface portions and into a condensate collection chamber in fluid communication therewith. At least a part of the condensate collection chamber lies radially outward of the outermost surface portions so that condensate collects therein by centrifugal force at high rotational speeds. A condensate transfer passage provides fluid communication between the condensate collection chamber and a condensate outlet which is associated with the axis of the roll. A pump located on the roll pumps condensate from the collection chamber through the transfer passage and to the condensate outlet. In a preferred embodiment of the invention, the pump is preferably located in the condensate collection chamber itself. The collection chamber preferably comprises a cylindrical bore and the pump includes a piston operable reciprocally in the bore. The radially outermost surface portion to which the condensate moves is preferably at one axial end of the outer wall and the inner surface portions comprise a plurality of circumferentially spaced axially extending condensate channels which are formed in the inner surface of the outer cylindrical wall of the roll. Condensate channels may be separated by inwardly extending heat exchange fins.

If the rotary steam heated roll includes a series of circumferentially spaced, generally parallel and axially extending open-ended steam tubes that are formed in the cylindrical outer wall of the roll, the condensate removal apparatus of the present invention includes at least one condensate collection chamber that is in fluid communication with at least one steam tube and has a radial outer surface which lies radially outward of the steam tube. A condensate transfer passage provides fluid communication between the collection chamber and the area of the rotational axis of the roll. A pump, which is located on the roll, pumps condensate from the collection chamber through the transfer passage for removal from the roll near the rotational axis thereof.

Preferably, a plurality of radially extending condensate transfer passages are positioned adjacent one end wall of the roll and provide condensate paths between ends of the steam tubes on one end of the roll and a condensate outlet in the end wall near the axis of rotation. Steam is supplied to the ends of the tubes on the other end of the roll. A condensate chamber interconnects each radial condensate transfer passage and the associated steam tube end. The chamber includes a sump which extends radially outward beyond the outermost radial surface of the tube. A small pump operates in the condensate chamber to provide a pressurized flow of condensate from the sump to the condensate transfer passage and through the transfer passage radially inwardly to the condensate outlet.

In one embodiment, the condensate chamber and the sump comprise a common cylindrical bore in one end wall of the roll. The bore has an axis extending radially with respect to the roll axis and generally parallel to the associated condensate transfer passage. The bore is provided with a piston which is reciprocably operated between an intake position permitting condensate to flow into the sump from the open end of the steam tubes and a discharge position closing the open end of the tube and causing the condensate to flow from the sump, past the piston and into the condensate transfer passage. More particularly, the condensate chamber and pump include a condensate flow inlet in the chamber wall positioned to be open to condensate flow from the steam tube ends into the sump in the piston intake position, and to be closed to condensate flow in the piston discharge position. The chamber wall is also provided with a condensate flow outlet positioned radially inward of the open end of the steam tube and providing a flow path between the piston and the condensate transfer passage. A condensate flow passage is provided within the piston to provide a flow path between the free end of the piston and the condensate flow outlet. The condensate flow passage includes a check valve biased to closed and adapted to be opened in response to piston movement to the discharge position. A pump drive, which may be selected from a wide variety of prime movers, reciprocably operates the piston in the bore.

In the presently preferred embodiment, the pump drive operates off of the driven main roll shaft which is attached to the roll end walls and provides roll rotation. A cam is journaled on the main shaft and fixed against rotation. The cam has an off-center circular outer cam surface which defines an eccentric orbital path around the axis of the shaft. Each piston includes a connecting rod which provides an operative connection between the piston and the cam surface to provide sequential operation of the series of pistons in response to roll rotation.

In an alternate embodiment, the pump drive may comprise a pressurized steam connection from the main steam supply operatively connected to the piston to provide timed reciprocal stroking, thereof between the discharge and intake positions. A suitable steam pressure control is provided to time the supply of piston operating steam to rotation of the roll for sequential operation of the pistons. Such timed control may operate through the use of a cam as described with respect to the preferred embodiment.

The condensate chamber and pump of the preferred embodiment may thus be operated and controlled by a wide variety of devices which are responsive to roll rotation provided by the main roll drive or other power means such as a steam turbine, electrically driven pump, or the like. In order to assure condensate removal at low roll speeds and when the roll is stopped, the pump drive control is preferably operative to provide piston movement to the intake position as the roll rotates to its lowermost position in the rotating roll, thereby permitting condensate discharge by steam pressure differential.

In a presently preferred embodiment of the invention, accommodation is made to capture blow-by steam from the ends of the steam tubes and to provide separate radially extending blow-by passages in one end wall, which passages are separate from condensate transfer passages, thereby providing nearly condensate-free blow-by steam. In this manner, blow-by steam may be transferred to another roll in a cascade arrangement. A steam blow-by passage may be provided in conjunction with each condensate chamber, pump and condensate transfer passage, or the steam blow-by passages may be provided completely independently thereof. In one embodiment, both the condensate transfer passages and the steam blow-by passages comprise radial passages in one end wall, and may be arranged therein to be circumferentially spaced from one another in an alternating pattern.

The condensate removal apparatus of the present invention may be applied to a more conventional steam heated roll of the type in which the entire roll interior is supplied with steam and in which the condensate collects on the interior of the cylindrical wall by centrifugal force during rotation. In this type of roll, the condensate may be caused to move to a radially outermost surface portion, collected in a condensate chamber from which it is pumped in a manner previously described. The pump is located on the roll, preferably near the outer axial end, and may be of any of the constructions previously described and operative to pump the condensate from the collection chamber to a transfer passage and thence to a condensate outlet.

BRIEF DESCRIPTION OF THE DRAWINGS

FIG. 1 is a perspective view showing the general arrangement of a rotary steam heated roll of the type in which the condensate pumping apparatus of the present invention is utilized.

FIG. 3 is a sectional end view of the roll taken on line 3—3 of FIG. 2 and additionally showing details of the pump drive mechanism.

FIGS. 4 and 5 are enlarged sectional details of the condensate pumping apparatus shown in FIG. and showing respectively the intake and pumping position of the pump piston.

FIG. 6 is a sectional end view similar to FIG. 3 showing details of an alternate pump drive mechanism.

FIG. 7 is a sectional detail taken on line 7—7 of FIG. 6.

DETAILED DESCRIPTION OF THE PREFERRED EMBODIMENTS

Figure 2:
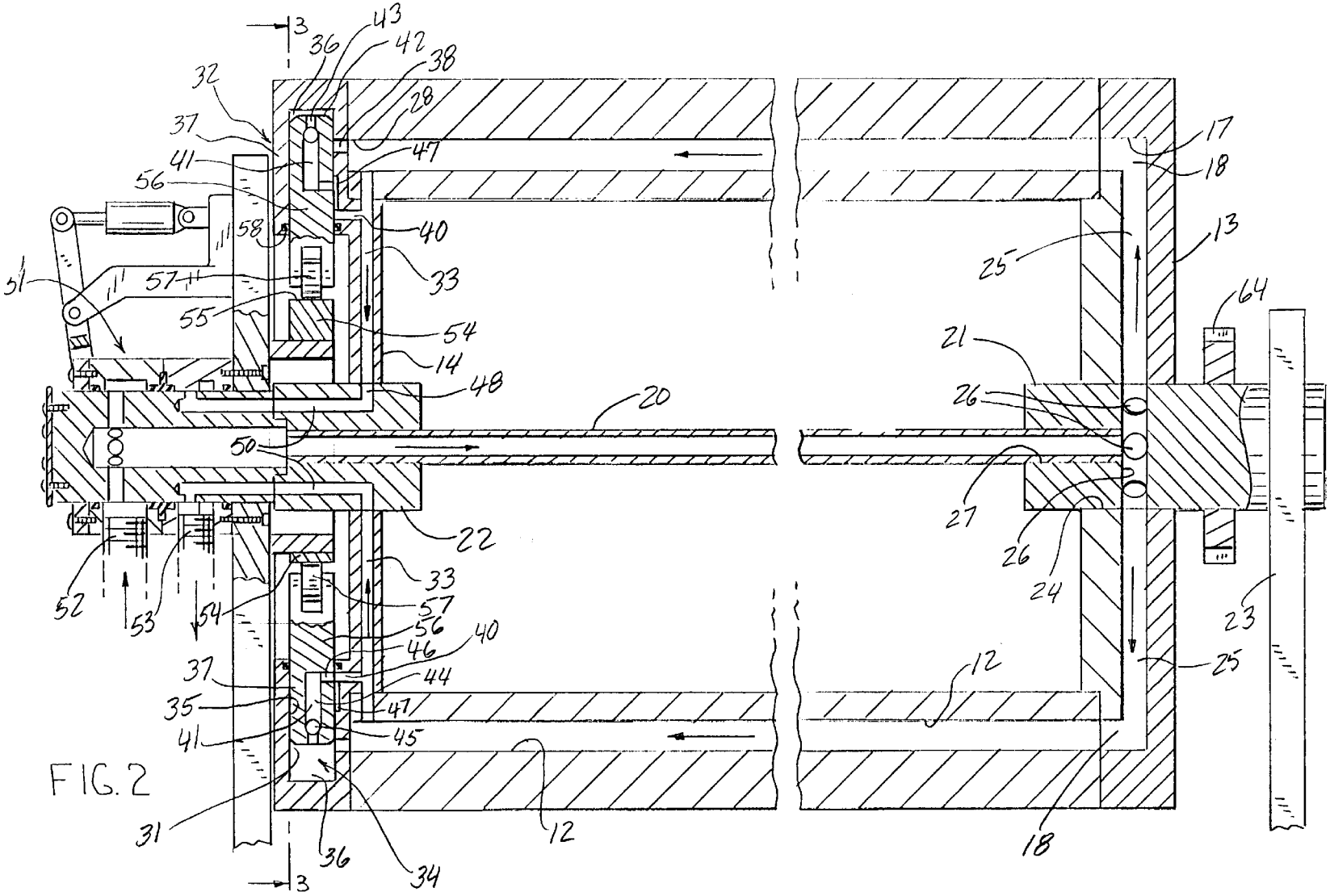
FIG. 2 is a schematic vertical section through a steam heated roll showing the overall steam and condensate flow paths and the condensate pumping apparatus in accordance with the one embodiment of the present invention.

The condensate removal apparatus of the present invention is shown in FIG. 2 as applied to a steam heated roll 10, a general arrangement of which is shown in FIG. 1, and which may be of any of various types which are rotatably driven or powered from a variety of sources and utilized to transfer heat to a web of material traveling around the outer cylindrical surface of the roll. However, the apparatus of the present invention is particularly adapted for use in a large diameter, high speed roll of the type used in papermaking applications. For example, the roll 10 may have a diameter of 72 inches (about 1,830 mm), an axial length of 400 inches (about 10 m), and be driven to accommodate a web line speed in excess of 6,000 fpm (about 30 m/s) resulting in a rotational speed of 320 rpm.

The roll 10 has a cylindrical outer wall 11 which is provided with a series of parallel and axially extending open-ended steam tubes 12 which are equally distributed circumferentially around the entire periphery of the wall 11. The outer cylindrical wall 11 is supported on a pair of opposite end wall or end bells, including a steam supply end wall 13 and a condensate return end wall 14 at opposite axial ends of the roll. Each of the two end walls 13 and 14 is of a similar construction and preferably made from relatively heavy plate stock. The end walls are preferably provided with cut-out or open sectors 15 (see FIG. 3) divided by radially extending spokes 16. The steam supply end wall 13 includes a large annular groove 17 which is circumferentially aligned with the open ends of the steam tubes 12 and forms a steam supply header 18. Steam supplied to the steam supply end wall 13 is distributed radially and uniformly to the steam header 18 (in a manner to be described), flows axially through the steam tubes 12, to the condensate return end wall 14 for collection and discharge in a manner to be described. In a presently preferred embodiment, which will be discussed below, steam blow-by is accommodated by providing separate radial condensate and blow-by paths.

A steam delivery tube 20 extends axially through the roll 10 between opposite stub shafts 21 and 22. Each of the end walls 13 and 14 is secured to its respective stub shaft 21 and 22 for rotation therewith. The steam supply end stub shaft 21 is rotatably supported on the machine frame 23 with a suitable bearing. The condensate end stub shaft 22 on the opposite end of the roll is also supported on the machine frame with a similar bearing. The steam delivery tube 20 interconnects the stub shafts 21 and 22. The steam supply end wall 13 includes a central stub shaft opening 24 through which the stub shaft 21 extends and is fixed to rotate therewith. The end wall 13 is provided with a series of steam transfer passages 25 which are spaced circumferentially around the roll axis and extend radially through the spokes 16 from the shaft opening 24 to the steam header 18. The inner end of each steam transfer passage 25 is aligned with a radial steam port 26 drilled in the stub shaft 21 and extending into an axial stub shaft bore 27. Steam supplied via the opposite stub shaft 22 travels along the steam delivery tube 20, into the stub shaft bore 27, through the steam ports 26 in the stub shaft 21, and radially outwardly along the steam transfer passages 25 into the steam supply header 18. Steam from the supply header 18 travels along the steam tubes 12 and condensate is collected in the condensate return end wall 14 for removal from the roll utilizing the apparatus of the present invention operating in tie following manner.

The steam tube ends 28 adjacent the condensate return end wall 14 open into an annular groove 30 which comprises a condensate header 31 interconnecting all of the steam tube ends 28. In the preferred embodiment of FIG. 8, which will be described below, a combined condensate and steam blow-by header is provided. A condensate pump 32 of the present invention is operatively connected to selected circumferentially spaced tube ends 28 to transfer condensate to associated radially extending condensate transfer passages 33 extending through the spokes 16 in the condensate return end wall 14, in a manner similar to the steam transfer passages 25 previously described with respect to the opposite end wall 13.

A series of identical condensate pumps 32 are provided in circumferentially spaced relation around the condensate return end wall 14 and positioned at the radially outer edge thereof. In FIG. 3, eight such condensate pumps are shown, each associated with an axially extending steam tube 12 and a radially extending condensate transfer passage 33. However, more or less pumps could be used and, preferably, in a roll of the type and size described above, as many as 16 or more pumps 32 might be used.

Each pump, shown in greater detail in FIGS. 4 and 5, operates in a condensate chamber 34 which provides a valved interconnection between the associated steam tube 12 and condensate transfer passage 33. The condensate chamber 34 comprises a cylindrical bore 35 having an axis which extends radially with respect to the rotational axis of the roll 10 and generally parallel to its associated condensate transfer passage 33. The cylindrical bore 35 includes a radially outermost end which defines a condensate sump 36. The sump extends radially outward beyond the outermost surface of the steam tube 12 such that centrifugal force produced by roll rotation will tend to move condensate in the associated steam tube 12, as well as condensate accumulating in the portions of the condensate header 31 on circumferentially adjacent sides of the associated steam tube, into the sump 36. As indicated previously, however, system steam pressure differential alone is insufficient to efficiently move condensate in the sump radially inwardly along the condensate transfer passages 33 at high speed rolls without an unacceptable drop in pressure at the condensate discharge.

A piston 37 is positioned in the cylindrical bore 35 for reciprocal motion along the axis thereof. In the radially innermost position of the stroke path of the piston 37, the piston is fully withdrawn from the sump 36 (which has a bore that is an extension of cylindrical bore 35). In this innermost intake position of the piston 37, a condensate flow inlet in the wall of the condensate chamber 34 is opened to condensate flow from the tube end 28 into the sump 36. The condensate flow inlet 38 is positioned to be generally aligned with the radially outermost surface portion of the steam tube 12 to accommodate the smooth uninterrupted flow of condensate which is caused to "rim" on that surface portion at high rotational roll speeds. A condensate flow outlet 40 is also provided in the wall of the condensate chamber 34 and is positioned radially inwardly of the open end 28 of the steam tube 12. The condensate flow outlet 40 provides a flow path between the piston and the condensate transfer passage 33. A condensate flow passage 41 in the piston 37 provides a flow path between the upper free end 42 of the piston and the condensate flow outlet 40. The condensate flow passage 41 includes a small diameter entrance port 43 in the free end of the piston which opens into a larger diameter flow chamber 44 within the piston body. The entrance port 43 is normally closed by a spring-biased check valve 45 suitably positioned in the flow chamber 44. The opposite end of the flow chamber includes a radially extending exit port 46 which communicates with the condensate flow outlet 40 via a shallow axially elongated annular circumferential slot 47 in the wall of the bore 35. The annular slot 47 permits condensate transfer from the exit port 46 to the condensate flow outlet 40 (and then into the condensate transfer passage 33) over a selected range of axial movement of the piston 37.

From the intake position of the piston 37 in FIGS. 2 and 4, and with the sump 36 filled with condensate moved by centrifugal force through the condensate flow inlet 38, the piston is stroked radially outwardly toward a condensate capture and discharge position shown in FIG. 5. Movement of the piston in the discharge stroke causes the side wall of the piston to close the condensate flow inlet 38 and the free end 42 of the piston to move into the sump 36. Compression of the condensate in the sump imposes an opening force on the check valve 45, opening the valve and allowing condensate to flow past the check valve into the flow chamber 44, through the exit port 46 and condensate flow outlet 40, and into the condensate transfer passage 33.

The radially inner ends of the condensate transfer passages 33 are connected to radial condensate ports 48 in the condensate end stub shaft 22. The stub shaft 22 is also provided with a plurality of circumferentially spaced axial blind condensate bores 50 which receive the return floral of condensate from the respective condensate transfer passages 33 in the end wall, via the radial condensate ports 48. A combined rotary steam joint and condensate discharge valve 51 of the type shown in commonly assigned co-pending U.S. patent application Ser. No. 09/089,124, filed on Jun. 2, 1998, the disclosure of which is incorporated by reference herein, may be utilized to control final condensate discharge from the roll 10, including normal blow-by steam. However, other condensate discharge valving may also be used. Thus, the rotary steam joint 51 includes a main steam inlet 52, a condensate discharge outlet 53 and, if provision is made to capture blow-by steam, a blow-by steam port. The apparatus of the present invention provides very clean blow-by steam, namely, steam which is virtually free of condensate. Blow-by steam also helps to move the condensate through the steam tubes 12 and into the condensate collection sump 36.

Referring also to FIG. 3, the several condensate pumps 32 are preferably operated serially in response to rotation of the roll 10 utilizing a camming arrangement operated off of the condensate end stub shaft 22. An eccentric cam 54 is mounted on the stationary housing 49 of the steam joint 51 and fixed against rotation. The cam is eccentrically mounted with respect to the shaft axis and has an outer cam surface 55 that defines an eccentric orbital path around the axis of the shaft 22. Thus, the shaft 22 and the roll 10, including the condensate end wall 14 with the condensate transfer passages 33, rotate around the eccentric cam surface 55. Each of the pistons 37 includes a connecting rod 56 which extends from the inner end of the piston radially inwardly to a free end to which is attached a cam roller 57. The connecting rods 56 are guided in suitable slide bearings 58. The cam rollers 57 bear on the cam surface 55 and, as the roll rotates, the connecting rods 56 and associated pistons 37 move in reciprocating paths to provide the condensate pumping action previously described. The roll may be driven in any suitable manner, as with a toothed drive belt engaging a drive sprocket 64 mounted on the opposite stub shaft 21 or by the felt carrier for the paper web which is common in paper machines.

FIGS. 6 and 7 show an alternate piston drive arrangement which includes a similar fixed cam 60 in the interior of which the stub shaft 22 rotates on a suitable ID bearing 61. A connecting ring 62 is mounted to rotate in an eccentric path around the cam 60. The connecting ring 62 includes a pivotal connecting pin 63 for each connecting rod end to take up any rocking motion imparted to the rod as it strokes the piston 37 in its path of reciprocal movement in response to rotation of the roll 10.

The piston operated pump 32 may be driven and controlled using a number of alternate arrangements. For example, system steam pressure, tapped from the internal steam supply and vented to atmosphere, may be supplied directly to the ends of the pistons 37 to provide the force to cause reciprocal pumping movement. However, pistons of substantially greater area would be needed. A steam pressure control valve may be timed to operate in response to rotation of the roll 10 in a manner similar to the directly driven pistons of the preferred embodiment, or may reciprocate based on the position of the pumping piston in a manner well known in the art of steam engine operation. Spent piston operating steam may be discharged directly to the atmosphere. Similarly, a miniature steam turbine could be utilized to drive a small gear pump or other type of pump placed in the flow path in lieu of the condensate pump 32 described above.

In order to assure that condensate will drain to the bottom of the roll 10 when the roll is stopped, the pistons 37 may be timed to position them in the intake position (with the respective condensate flow inlets 38 open) when the piston (s) is at or near the bottom of its rotational path, as will be described in greater detail below with reference to FIG. 8B. Correspondingly, the pistons in their upper positions in the roll may be timed to be in the discharge position, thereby closing the associated condensate flow inlets 38.

Figure 8A:
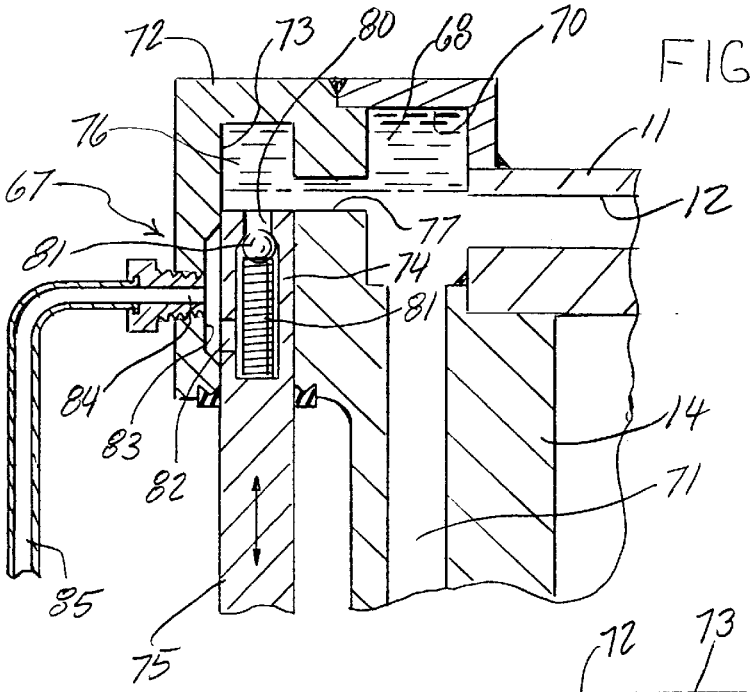
FIG. 8A is an enlarged sectional detail, similar to FIG. 4, showing the presently preferred condensate pumping apparatus of the present invention in the uppermost or 12:00 o'clock position in the roll.

The presently preferred embodiment of the condensate pump 67 is shown in FIG. 8A. In this embodiment, the steam tubes 12 open directly into an annular circumferential condensate header 58 formed in the condensate end wall 14. The condensate header 68 includes an annular sump 70 in which condensate accumulates by rimming at high speeds or in the bottom of which condensate pools at low speeds or when the roll is stopped.

It is often useful to capture blow-by steam which passes through the steam tubes 12 and assists in moving the condensate axially through the tubes. The steam which exits the steam tubes has a very low condensate content because centrifugal force from roll rotation removes a large amount of condensate. This blow-by steam may be diverted for recirculation or transferred to another roll in a so-called "cascade" arrangement.

To accommodate steam blow-by, a series of radially extending steam blow-by passages 71 extend from the condensate header 68 inwardly to a convenient collection or diversion point near the axis of the roll. In this embodiment, separate accommodation for the removal of condensate is provided in a manner which utilizes a slightly modified pump 67 from the embodiment previously described. The pump 67 is contained in an external pump housing 72 which may be attached to the end wall 14 axially outwardly of the condensate header 68. The pump housing 72 is provided with a radial cylindrical bore 73 that houses a radially reciprocable piston 74, similar to the piston 37 of the previously described embodiment. Piston 74 includes a connecting rod 75 which may be driven in a manner identically described with respect to the condensate pump 32 of the previously described embodiment.

The radially outer end of the pump bore 73 includes a pump cavity 76 within which a portion of the condensate from the sump 70 flows via a condensate flow inlet 77 extending through the wall of the pump housing 72. The condensate flow inlet 77 is positioned such that when the piston 74 is in its retracted intake position (as shown in FIG. 8A), condensate flow into the pump cavity 76 is unrestricted. As the piston 74 is stroked radially outwardly to its discharge position, the condensate flow inlet 77 is closed off and, as the piston enters the pump cavity 76, the pressurization of the condensate therein forces a spring-biased check valve 70 to open so that the condensate can enter an entrance port 80 in the free end of the piston, pass through a flow chamber 81 therein and leave via a lateral exit port 82 in the wall of the flow chamber. From the exit port 82, the condensate enters a shallow recess 83 in the cylindrical bore 73 which communicates with a centrally located condensate flow outlet 84 in the wall of the pump housing 72. A condensate transfer tube 85 is connected to the flow outlet 84 to carry the pumped condensate radially inward to the stub shaft 22 for discharge in the same manner described with respect to the FIG. 2 embodiment.

Figure 8B:
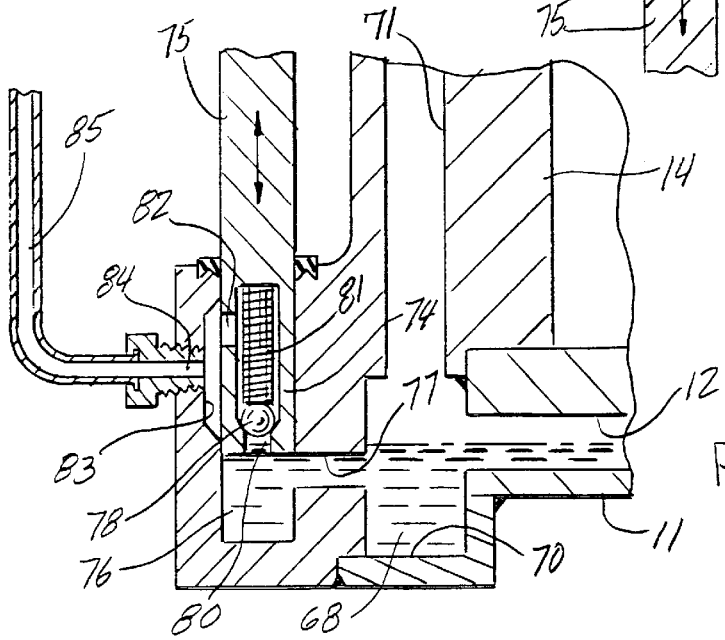
FIG. 8B is a sectional detail similar to FIG. 8A showing the pumping apparatus in the lowermost or 6:00 o'clock position in the roll.

FIG. 8B shows the preferred embodiment of the condensate pump 67 in the lowermost 6:00 position in the roll. It is important that the pump 67 in this position be operable to pump condensate from the bottom of the roll which drains by gravity to the bottom when roll rotation is stopped or if the roll is rotating at a very low speed. As shown in the figure, the condensate may pool in steam tubes 12, annular sump 70 and pump cavity 76. If the roll is not rotating and the pump piston 74 is inoperative, blow-by steam pressure may be utilized to force the condensate through the piston and out through the condensate transfer tube 85. However, in order to allow blow-by steam pressure to act on condensate, the steam blow-by passage 71 must be temporarily closed. This may be accomplished by utilizing a rotary steam joint 51, such as is described in the co-pending application identified above. Other closure means operative directly in the blow-by passage 71 may also be utilized.

With the steam blow-by passage 71 closed, steam pressure will cause the check valve 78 to open, thereby allowing the condensate to pass through the piston flow chamber 81, exit port 82, condensate flow outlet 84, and into the condensate transfer tube 85 for discharge. As indicated previously with respect to the embodiment of the pump shown in FIGS. 4 and 5, the rotary pump drive mechanism is operable to cause the piston 74 in the 6:00 position of FIG. 8B to be in its upper intake position so the associated pump cavity 76 is open to the flow of condensate.

In a slightly modified arrangement from that shown in FIGS. 8A and 8B, each of the condensate pumps 67 may be offset circumferentially from a steam blow-by passage 71 such that the pumps and the blow-by passages alternate in circumferentially spaced relationship around the end wall 14. In this manner, the condensate transfer tubes 85 could be replaced with radial bores similar to) the blow-by passages 71 (or similar to the condensate transfer passages 33 of the previously described embodiment). In other words, a radial array of alternating blowby passages 71 and condensate transfer passages would lie in a generally common plan in the condensate return end wall 14. In this arrangement, the piston exit port 82, shallow recess 83, and condensate flow outlet 84 would extend axially inwardly with respect to the roll axis to the condensate transfer passage (not shown) similar in construction to the blow-by passage 71.

Figure 9:
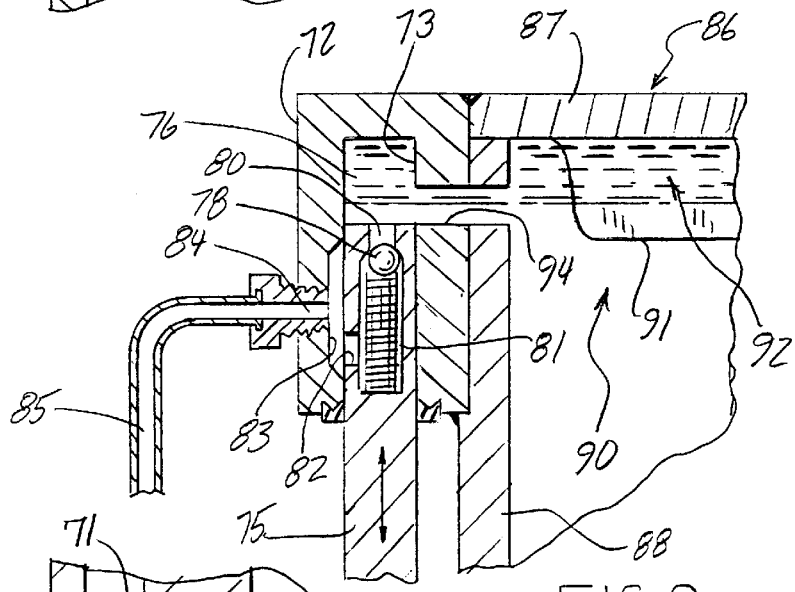
FIG. 9 is a schematic sectional detail of a roll in which steam is applied to the open interior and to which the pumping apparatus of the present invention is applied.

In FIG. 9, the pumping apparatus of the present invention is shown as utilized in a roll in which the steam is applied to the entire opened interior. The roll 86 of this embodiment includes a cylindrical wall 87 which extends between opposite end walls 88 (only one of which is partially shown). The entire opened interior 90 of the roll 86 is supplied with steam, typically through a conventional rotary joint in the roll axis. The interior of the cylindrical wall 87 may be provided with a series of circumferentially spaced and axially extending heat transfer fins 91. The fins 91 extend radially inwardly from the interior wall to form axially extending, channels 92 between adjacent fins. Between the axial ends of the fins 91 and one end wall 88, an annular condensate channel 93 is formed. At high rotational roll speeds, the condensate which moves to the inside surface of the cylindrical wall 87 by rimming, will accumulate in the condensate channel 93, as in the previously described embodiments.

Condensate is removed from the condensate channel 93 by utilizing a reciprocal piston pump 67 which may be identical to the pump previously described with respect to the FIG. 8 embodiment. Thus, common reference numbers will be used to refer to the pump. A condensate flow inlet 94 provides fluid communication between the condensate channel 93 and the pump cavity 76, defined by the end wall 88 and a pump housing 72 attached thereto. Movement of the pump piston 74 into the bore 73 closes off the condensate inlet 94, forces the spring-baised check valve 70 to open, and allows the condensate to pass through the piston and into the condensate transfer tube 85 for discharge, all in a manner previously described.

I claim:

1. A condensate removal apparatus for a steam heated roll rotatable on a generally horizontal axis and having a generally cylindrical outer wall, wherein steam condensate moves radially outward toward interior surface portions of the roll during roll rotation and is directed to a radially outermost one of said surface portions, the roll including outer end walls at each end of the outer wall, said apparatus comprising:

at least one condensate collection chamber in fluid communication with said outermost surface portion, at least a part of said collection chamber lying radially outward of said outermost surface portion;

a condensate transfer passage providing fluid communication between said collection chamber and a condensate outlet associated with the axis of the roll; and, a pump, located on the roll, for pumping condensate from said collection chamber through said transfer passage to the condensate outlet.

2. The apparatus as set forth in claim 1 wherein said pump is located in the condensate collection chamber.

3. The apparatus as set forth in claim 2 wherein said condensate collection chamber comprises a cylindrical bore and said pump includes a piston operable reciprocally in said bore.

4. The apparatus as set forth in claim 1 wherein said outermost surface portion is located at one axial end of the cylindrical outer wall.

5. The apparatus as set forth in claim 1 wherein said inner surface portions comprise a plurality of circumferentially spaced axially extending condensate channels formed in the inner surface of the cylindrical outer wall.

6. The apparatus as set forth in claim 5 wherein adjacent condensate channels are separated in the axial direction of the roll by radially extending heat exchange fins.

7. The apparatus as set forth in claim 1 wherein said inner surface portions comprise a plurality of circumferentially spaced axially extending enclosed steam passages formed in the outer wall.

8. The apparatus as set forth in claim 7 wherein said condensate collection chamber is in fluid communication with one axial end of a steam passage.

9. A condensate removal apparatus for a steam heated roll rotatable on a generally horizontal axis and having a cylindrical outer wall with a plurality of circumferentially spaced axially extending steam passages formed in the outer wall and connected to a supply of steam, for receiving steam and associated condensate, and outer end walls at each end of the outer wall, said apparatus comprising:

at least one condensate collection chamber in fluid communication with at least one steam passage, the radial outer edge of said collection chamber extending radially outward at least to the radial outer edge of the steam passage;

a condensate transfer passage providing fluid communication between said collection chamber and the general area of the axis of the roll; and, a pump, located on the roll, for pumping condensate from said collection chamber through said transfer passage to the general area of the axis of the roll.

10. The apparatus as set forth in claim 9 wherein the radial outer edge of said collection chamber extends radially outward beyond the radial outer edge of the steam passage.

11. The apparatus as set forth in claim 9 wherein said pump is located in the condensate collection chamber.

12. The apparatus as set forth in claim 11 wherein said condensate collection chamber comprises a cylindrical bore and said pump includes a piston operable reciprocally in said bore.

13. The apparatus as set forth in claim 12 including a pump drive comprising:

a driven main shaft attached to the end walls and providing roll rotation;

a cam journaled on the main shaft and fixed against rotation, said cam having a radial outer cam surface defining an eccentric orbital path around the axis of the shaft; and, a connecting rod providing operative connection between the piston and the cam surface to operate the piston in response to roll rotation.

14. The apparatus as set forth in claim 13 wherein said condensate transfer passage comprises a radially extending condensate path to a condensate outlet in the main shaft.

15. The apparatus as set forth in claim 9 including a separate condensate collection chamber, transfer passage, and pump for each of selected ones of said plurality of steam passages.

16. A condensate removal apparatus for a steam heated roll rotatable on a generally horizontal axis and having a cylindrical outer wall, a pair of supporting end walls, a series of circumferentially spaced, generally parallel and axially extending open-ended steam tubes in heat conducting contact with the cylindrical outer wall, a plurality of radially extending condensate transfer passages adjacent one end wall and providing condensate paths between the open ends of the tubes on one end of the roll and a condensate outlet in said one end wall, and a steam supply connected to the open ends of the tubes on the other end of the roll, said apparatus further comprising:

a condensate chamber interconnecting each condensate transfer passage and the associated tube end, the chamber including a sump extending radially outward beyond the outermost surface of the tube; and, a pump operating in the condensate chamber to provide a pressurized flow of condensate from the sump to the condensate transfer passages and therethrough radially inwardly to the condensate outlet.

17. The apparatus as set forth in claim 16 wherein said condensate chamber and said sump comprise a common cylindrical bore in said one end wall and having an axis extending radially with respect to the roll axis and generally parallel to the associated condensate transfer passage; and wherein said pump comprises:

a piston reciprocably operative in the bore between an intake position permitting condensate to flow into the sump from the open end of the tube and a discharge position closing said open end and causing condensate to flow from the sump, past the piston and into the condensate transfer passages.

18. The apparatus as set forth in claim 17 wherein said condensate chamber and pump comprise:

a condensate flow inlet in the chamber wall adapted to be open to condensate flow from the tube end into the sump in the intake position of the piston and adapted to be closed to condensate flow in the discharge position of the piston;

a condensate flow outlet in the chamber wall positioned radially inward of the open end of the steam tube, said flow outlet providing a flow path between the piston and the condensate transfer passage;

a condensate flow passage in the piston providing a flow path between the free end of the piston and the condensate flow outlet;

a check valve in said condensate flow passage biased to closed and adapted to be opened in responds to piston movement to the discharge position; and, a pump drive for reciprocably operating the piston.

19. The apparatus as set forth in claim 18 wherein said pump drive comprises:

a driven main shaft attached to the end walls and providing roll rotation;

a cam journaled on the main shaft and fixed against rotation, said cam having a radial outer cam surface defining an eccentric orbital path around the axis of the shaft; and, a connecting rod for each piston providing operative connection between the piston and the card surface to provide sequential operation of the series of pistons in response to roll rotation.

20. The apparatus as set forth in claim 18 including:

a main roll drive for rotating the roll on its axis; and, a pump drive control responsive to roll rotation.

21. The apparatus as set forth in claim 20 wherein said pump drive control is operative to provide piston movement to the discharge position as the piston rotates to its uppermost position in the rotating roll.

22. The apparatus as set forth in claim 20 wherein said pump drive control is operative to provide piston movement to the intake position as the piston rotates to its lowermost position in the rotating roll.

23. The apparatus as set forth in claim 22 including a condensate by-pass passage providing a direct condensate path from each tube end upstream of the condensate flow inlet to the associated condensate transfer passage; and, a by-pass valve in the by-pass passage adapted to close by centrifugal force at a given rotational roll speed, and adapted to open by gravity at a rotational speed below said given speed.

24. A condensate removal apparatus for a steam heated roll rotatable on a generally horizontal axis and having a cylindrical outer wall, a pair of supporting end walls, a series of circumferentially spaced, generally parallel and axially extending open-ended steam tubes in heat conducting contact with the cylindrical outer wall, a plurality of radially extending condensate transfer passages adjacent one end wall and providing condensate paths between the open ends of at least some of the tubes on one end of the roll and a condensate outlet in said one end wall, and a steam supply connected to the open ends of the tubes on the other end of the roll, said apparatus further comprising:

a condensate chamber interconnecting each condensate transfer passage and the associated tube end, the chamber including an outer surface extending radially outward beyond the outermost surface of the tube; and, a pump positioned on the roll and operative to provide a pressurized flow of condensate from the condensate chamber to the condensate transfer passages and therethrough radially inwardly to the condensate outlet;

a plurality of radially extending steam blow-by passages adjacent said one end wall and providing steam blow-by paths between the open ends of at least some of the tubes on one end of the roll and a blow-by outlet in said one end wall.

25. The apparatus as set forth in claim 24 including a condensate transfer passage and a steam blow-by passage for each of said steam tubes.

26. The apparatus as set forth in claim 24 including an annular condensate header in said one end wall interconnecting the ends of the steam tubes, and a condensate flow inlet providing fluid communication between the condensate header and each condensate collection chamber.

27. The apparatus as set forth in claim 26 wherein said condensate transfer passages and said steam blow-by passages are formed in said one end wall and are spaced circumferentially therein from one another.

* * * * *